US008327956B2

(12) United States Patent
Drews et al.

(10) Patent No.: US 8,327,956 B2
(45) Date of Patent: Dec. 11, 2012

(54) MULTI-SET PDC DRILL BIT AND METHOD

(75) Inventors: Steven W. Drews, Cypress, TX (US); Cary Maurstad, Friendswood, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 210 days.

(21) Appl. No.: 12/636,506

(22) Filed: Dec. 11, 2009

(65) Prior Publication Data

US 2010/0155151 A1 Jun. 24, 2010

Related U.S. Application Data

(60) Provisional application No. 61/139,441, filed on Dec. 19, 2008.

(51) Int. Cl.
*E21B 10/36* (2006.01)

(52) U.S. Cl. ..... 175/431

(58) Field of Classification Search ..... 175/331, 175/376, 378, 398, 413, 426, 429, 431
See application file for complete search history.

(56) References Cited

U.S. PATENT DOCUMENTS

| | | | | |
|---|---|---|---|---|
| 3,696,875 | A | 10/1972 | Cortes | |
| 3,768,581 | A | 10/1973 | Rederon | |
| 4,429,755 | A | 2/1984 | Williamson | |
| 4,440,247 | A | 4/1984 | Sartor | |
| 4,545,441 | A | 10/1985 | Williamson | |
| 5,222,566 | A | 6/1993 | Taylor et al. | |
| 5,265,685 | A | 11/1993 | Keith et al. | |
| 5,651,421 | A | 7/1997 | Newton et al. | |
| 6,564,886 | B1 * | 5/2003 | Mensa-Wilmot et al. | 175/331 |
| 7,896,106 | B2 * | 3/2011 | Gavia | 175/57 |
| 2002/0066601 | A1 * | 6/2002 | Meiners et al. | 175/431 |
| 2007/0078632 | A1 * | 4/2007 | Shen et al. | 703/1 |
| 2007/0261890 | A1 | 11/2007 | Cisneros | |
| 2007/0278014 | A1 * | 12/2007 | Cariveau | 175/331 |
| 2008/0105466 | A1 * | 5/2008 | Hoffmaster et al. | 175/73 |
| 2008/0179107 | A1 * | 7/2008 | Doster | 175/431 |
| 2008/0179108 | A1 | 7/2008 | McClain et al. | |
| 2008/0302575 | A1 * | 12/2008 | Durairajan et al. | 175/327 |

(Continued)

FOREIGN PATENT DOCUMENTS

EP 0710765 2/2001

(Continued)

OTHER PUBLICATIONS

International Search Report, PCT/US2009/068573, Feb. 19, 2010, 2 pages.

(Continued)

*Primary Examiner* — Kenneth L Thompson
*Assistant Examiner* — Michael Wills, III
(74) *Attorney, Agent, or Firm* — Gardere Wynne Sewell LLP; Andre M. Szuwalski

(57) ABSTRACT

A PDC bit includes a plurality of blades including primary blades and secondary blades. The included primary blades are set with PDC cutters in accordance with a "single set" methodology. The included secondary blades, however, are set with PDC cutters using a type of "plural set" methodology such that the radial positions of cutters on a secondary blade match the radial positions of cutters on a single set primary which is immediately preceding that secondary blade. Plural secondary blades can be positioned to follow a single primary blade, and the cutters on those plural secondary blades will have radial positions matching the cutters of the immediately preceding single set primary blade.

15 Claims, 3 Drawing Sheets

U.S. PATENT DOCUMENTS

2009/0145669 A1* 6/2009 Durairajan et al. ..... 175/431

FOREIGN PATENT DOCUMENTS

GB 2294712 5/1996

OTHER PUBLICATIONS

Written Opinion of the International Searching Authority, International Application No. PCT/US2009/068573, Feb. 19, 2010, 5 pages.
Weaver, G.E. et al, "A New PDC Cutting Structure Improves Bit Stabilization and Extends Application Into Harder Rock Types", SPE/IADC 25734, Copyright 1993, SPE/IADC Drilling Conference, pp. 537-548.
Clayton, R.I., "Development of Whirl Resistant PDC Bits", SPE 26954, Copyright 1994, Society of Petroleum Engineers, pp. 625-637.
Dahlem, J.S., et al. "The Application of Advanced PDC Concepts Proves Effective in South Texas", SPE Drilling & Completion, Dec. 1996, pp. 221-227.
"Security DBS Drill Bits, The FM2000 Bit Series", Halliburton, Oct. 2005, 2 pages.
"TransFormation Bits", http://www.reedhycalog.com/FC/Products/tffla.html, Jan. 15, 2009, 6 pages.
"TransFormation Bits, The Bits that Transform as the Formation Changes", Sharp Solutions, Reed Hycalog, 2004, 8 pages.

* cited by examiner

MULTI-SET PDC DRILL BIT AND METHOD

CROSS-REFERENCE TO RELATED APPLICATION

This application claims the benefit of U.S. Provisional Application for Patent No. 61/139,441 filed Dec. 19, 2008, the disclosure of which is incorporated by reference.

TECHNICAL FIELD

The present invention relates generally to earth boring bits, and more particularly to bits which use polycrystalline diamond compact (PDC) cutters mounted to bit blades for drilling a variety of rock types.

BACKGROUND

Polycrystalline diamond compact (PDC) drill bits are set with PDC cutters mounted to bit blades. Many methods for defining the setting patterns for such PDC cutters are known in the art. The goals to be achieved with respect to any PDC cutting pattern include: enhancing the force balancing of the drill bit; improving the cleaning of the bit face; evening out the wear of the cutters across the bit face; improving the durability of the bit; and achieving improved rates of penetration by more effectively attacking the rock to be drilled.

Two known setting patterns with respect to PDC cutters are: the "single set" method and the "plural set" method. In the single set method, each PDC cutter that is positioned across the face of the bit is given a unique radial position measured from the center axis of the bit outwards towards the gage. One commonly utilized technique for implementing a single set pattern is to define a spiral function originating at the bit axis and then place individual PDC cutters at points where the spiral function intersects each blade location. The spiral-blade intersection points will each be located at a distinct radial distance from the bit axis. With respect to a plural set pattern (also known as "redundant cutter" or "tracking cutter" pattern), PDC cutters as deployed in sets containing two or more cutters each, wherein the cutters of a given set are positioned at a same radial distance from the bit axis. Because of the reduced area near the center of the bit face, there may be fewer blades, and thus not every PDC cutter on the bit is assured to be a member of a set positioned at the same radius, but the majority of the included cutters do belong to a set. The typical plural set pattern distributes the cutters included in each set (at the same radius) across the bit face (for example, on opposite blades).

Single set PDC bits tend to drill faster for a given total cutter density than do plural set PDC bits. A weakness with PDC single set bits lies in the fact that if an individual cutter is damaged or lost then wear is accelerated on the cutters in proximate radial positions to the lost cutter. This can lead to premature failure of the drill bit. Plural set PDC bits are typically more durable than single set PDC bits, but are also known for lower rates of penetration.

A near constant theme in the prior art concerning plural set bits holds that at least one of the circumferentially trailing cutters of a given cutter set should be exposed less than the leading cutters. This is done in the hope that the bit will act as a light set low cutter density bit until the primary cutters are worn down and then act as a heavier set higher cutter density bit in deeper, harder drilling situations when the less exposed secondary cutters come into play. In practice, however, these plural set PDC bits have slow rates of penetration even when first deployed and have even slower rates of penetration when they become minimally worn.

Early examples of plural set bits include bits where the cutter sets were deployed symmetrically in circumferential placement (i.e., 180 degrees apart for sets with 2 cutters and 120 degrees apart for sets with 3 cutters). This type of bit could incorporate a uniform location on the bit profile for all of the cutters on the bit. More recent examples of plural set PDC bits tend to have decreased or offset location on the bit profile of the trailing cutters in the cutter sets or if the location on the bit profile is equal they tend to vary the overlap of adjacent cutter sets to create areas where the rock face will be ridged while drilling to limit lateral vibration of the bit. These more recent designs are characterized by having an even number of blades and tend to have the cutter sets deployed symmetrically in circumferential placement.

The setting of cutters on bits has been well documented in the patent art. Reference is made to Williamson U.S. Pat. Nos. 4,429,755 and 4,545,411, the disclosures of which are hereby incorporated by reference. Reference is also made to Keith and Mensa-Wilmot U.S. Pat. Nos. 5,238,075, 5,265,685, 5,549,171, 5,551,522, 5,582,261, 5,592,996, 5,607,024, 5,607,025, 5937,958, and 6,164,394, the disclosures of which are hereby incorporated by reference. Reference is also made to Cortes U.S. Pat. No. 3,696,875, the disclosure of which is hereby incorporated by reference. Reference is further made to McClain U.S. Application for Patent No. 2008/0179108, the disclosure of which is hereby incorporated by reference.

SUMMARY

The present invention employs a novel setting pattern method referred to as "multi-set" which is distinguished from the "single set" and "plural set" patterns of the prior art.

In an embodiment, a plurality of blades for the bit are set with PDC cutters in accordance with the traditional "single set" methodology. These are referred to as primary blades of the bit. At least one other additional blade, referred to as a secondary blade, is set with PDC cutters using a type of "plural set" methodology such that each cutter on that additional blade is placed at a radial position that is identical to ones of the single set cutters which are located on a primary blade which is immediately preceding that additional secondary blade (in the direction of rotation). These plural set cutters on the additional secondary blade(s) are preferably set with an equal or nearly equal location on the bit profile as the single set cutters on the immediately preceding primary blade.

In a more specific implementation, 2, 3, 4, or 5 primary blades of a bit have PDC cutters set using the traditional "single set" methodology, while one or more additional secondary blades have PDC cutters, with equal or near equal location on the bit profile, that are set as redundant, plural set, cutters. The radial position of the redundant cutters on the additional secondary blade is equal to the radial position of ones of the single set cutters on the immediately preceding single set primary blade.

The combined single set and plural set setting pattern for PDC cutters as described above gives rise to a bit having a "multi-set" cutter pattern. Such a multi-set cutter pattern advantageously provides a bit having the faster drilling capability (ROP) for a given total cutter density characteristic of single set bits in combination with the enhanced durability characteristic of plural set (redundant) bits.

An exemplary multi-set bit embodiment has 5 blades. Two primary blades (of the five total blades) are laid out with PDC cutters positioned in accordance with the single set method. A first one of the single set primary blades is then immediately backed up by two additional (trailing) secondary blades which are laid out with PDC cutters positioned in accordance with the plural set method such that each cutter on the trailing secondary blades has a radial position matching ones of the cutters on the first primary blade (i.e., redundant of the immediately preceding primary blade). A second one of the single set primary blades is then immediately backed up by one additional (trailing) secondary blade which is laid out with PDC cutters positioned in accordance with the plural set method such that each cutter on the trailing secondary blade has a radial position matching ones of the cutters on the second primary blade (i.e., redundant of the immediately preceding primary blade).

Although a five bladed design is given as exemplary, it will of course be understood that the multi-set concept can be extended to bit designs having any selected odd or even number of blades. For example, four-bladed to twelve-bladed implementations are contemplated herein.

This multi-set approach is counter intuitive and would presumably make the bits difficult to force balance. It has been discovered, to the contrary and with some surprise, that a multi-set bit as described is more readily force balanced than prior art single set bits or prior art plural set bits. The near trailing adjacency of the redundant secondary blades coupled with the equivalent location on the bit profile of the redundant cutters means that the redundant cutters remove a minimum of rock per revolution as the bit is twisted down into the rock. The single set primary cutters on the primary blades do most of the work and the redundant cutters on the secondary blades trim only the bottom of the rock groove not excavated by the preceding primary cutter. In field trials multi-set bits as described herein drill approximately 20% faster than equally densely set traditional plural set bits while exhibiting equal or improved longevity in comparison to prior art bits. In addition multi-set bits have proven to be very stable in operation and very good at maintaining verticality in vertical drilling implementations. The multi-set method provides a bit which achieves the combined goal of increased ROP and enhanced durability.

DETAILED DESCRIPTION OF THE DRAWINGS

Figure 1:
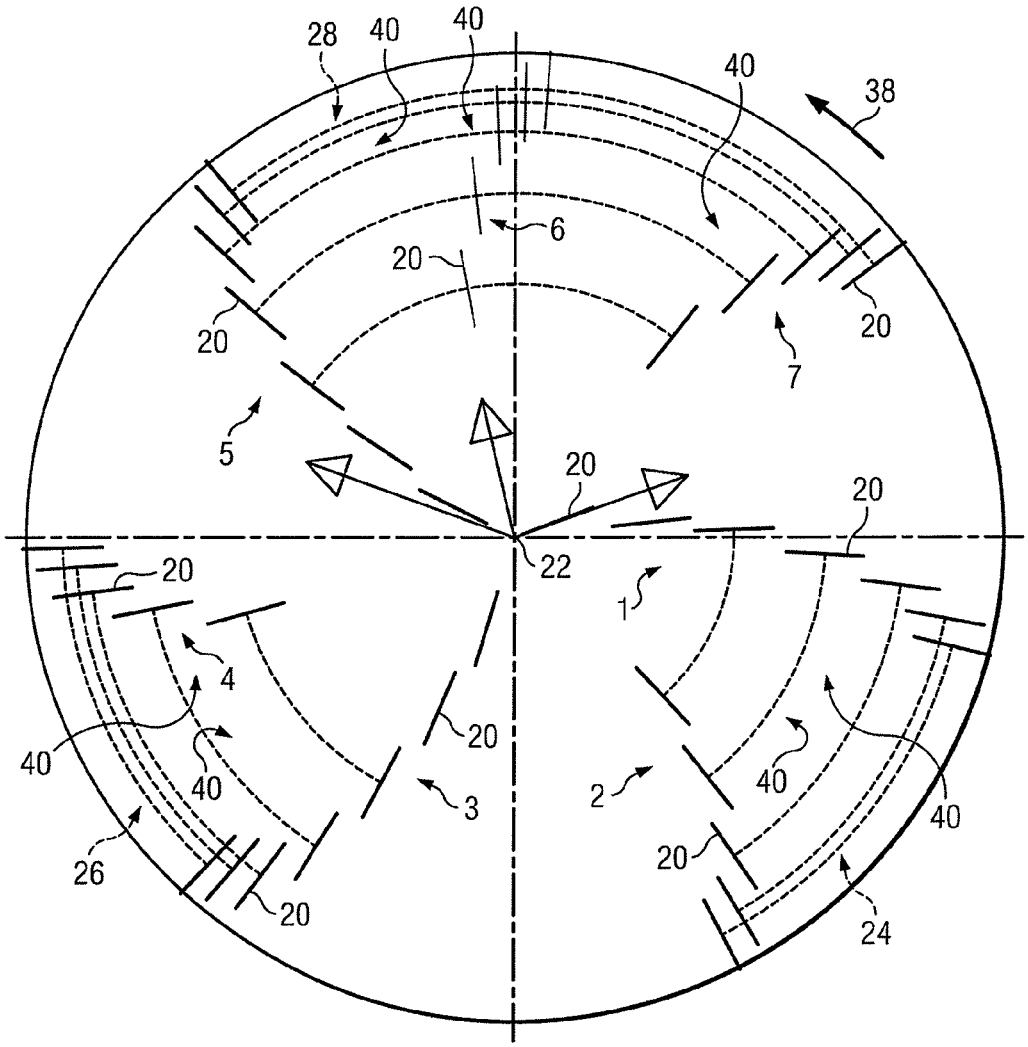
FIG. 1 illustrates a face layout for an exemplary seven bladed bit whose PDC cutters have been set in accordance with the multi-set pattern.

Reference is now made to FIG. 1 which illustrates a face layout for an exemplary seven bladed bit whose PDC cutters have been set in accordance with the multi-set pattern of the present invention. Blades 1, 3 and 5 comprise the "primary blades" of the bit. These primary blades 1, 3 and 5 are set with PDC cutters (schematically represented by a line 20 defining the cutter face) in accordance with the traditional "single set" methodology such that each cutter is at a unique radial location. For example, the single set methodology used in FIG. 1 comprises the conventional spiral-blade intersection technique. Blades 2, 4, 6 and 7, however, comprise "secondary blades" of the bit. These secondary blades 2, 4, 6, and 7 are set with PDC cutters (again schematically represented by a line 20 defining the cutter face) in accordance with a type of redundant, "plural set," methodology as described herein to form a multi-set bit.

More specifically, secondary blade 2 is plural set with the immediately preceding (in the direction of rotation 38) primary blade 1 such that each of the PDC cutters provided on secondary blade 2 is positioned at a same radial distance from the axis 22 of the bit as corresponding ones of the PDC cutters provided on primary blade 1. This common radial positioning between blade 2 PDC cutters and some blade 1 PDC cutters is illustrated by arcuate dotted lines 24 on FIG. 1, each such line 24 defining a set of cutters. Likewise, secondary blade 4 is plural set with immediately preceding primary blade 3 such that each of the PDC cutters provided on secondary blade 4 is positioned at a same radial distance from the axis 22 of the bit as corresponding ones of the PDC cutters provided on primary blade 3. This common radial positioning between secondary blade 4 PDC cutters and some primary blade 3 PDC cutters is illustrated by arcuate dotted lines 26 on FIG. 1, each such line 26 defining a set of cutters. Still further, secondary blades 6 and 7 are plural set with immediately preceding primary blade 5 such that each of the PDC cutters provided on secondary blades 6 and 7 are positioned at a same radial distance from the axis 22 of the bit as corresponding ones of the PDC cutters provided on primary blade 5. Additionally, it should be noted that the PDC cutters on secondary blades 6 and 7 share common radial positions with each other. This common radial positioning between secondary blade 6 and blade 7 PDC cutters and some primary blade 5 PDC cutters is illustrated by arcuate dotted lines 28 on FIG. 1, each such line 28 defining a set of cutters. Because blade 7 follows secondary blade 6 and has an identical configuration layout, blade 7 may alternatively be referred to as a "tertiary" blade. For ease of description herein, the term "secondary" refers to one or more blades immediately trailing a primary blade which have common radial PDC cutters positions with respect to that immediately preceding primary blade (in other words, "secondary" would cover both secondary and tertiary blades with commonly set PDC cutters to the immediately preceding primary blade).

Figure 2:
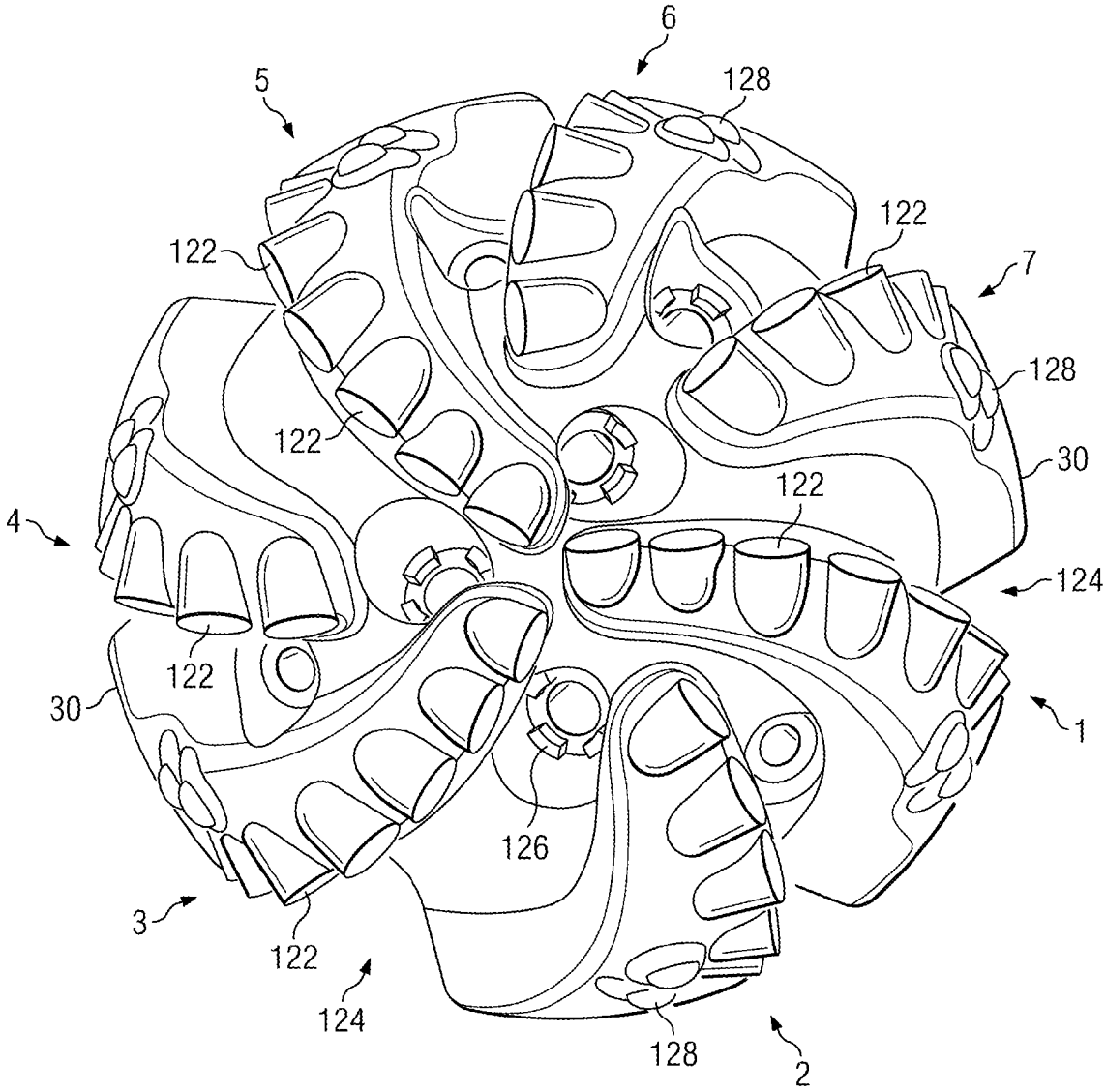
FIG. 2 illustrates a face view of a bit having a multi-set PDC cutter layout as shown in FIG. 1.

FIG. 2 illustrates a face view of a bit having a multi-set PDC cutter layout as shown in FIG. 1 (with the same orientation). The correspondence between the lines 120 and the actual placement of cutters 122 on the bit is readily apparent. Furthermore, the relationship between the included blades (primary and secondary) and other features of the bit such as junk slots 124, nozzles 126 and shock studs 128 is readily apparent. The gage region 30 of the bit is also shown. It will be noted that the secondary blades 2, 4, 6 and 7 are shorter than the primary blades 1, 3 and 5. This is exemplary and will not in all situations be the case.

Reference is now made to the following Table which provides information concerning the face layout of FIG. 1. The left column identifies the number of the PDC cutter. Thus, it will be noted that there are thirty-four PDC cutters included in the layout for the FIG. 1 bit. The center column identifies the radial position of each cutter on the bit (this radial position being measured in millimeters from the axis 22 either as a direct radial measurement or a measurement along the bit profile). The right column identifies the blade on which the PDC cutter has been positioned. A review of the radial positions for the cutters associated with primary blades 1, 3 and 5 reveals that each of these cutters, solely in the context of the primary blades, has a unique radial position. In other words, these primary blades 1, 3 and 5 are set with PDC cutters in accordance with the traditional "single set" methodology. A review of the radial positions for the cutters associated with secondary blades 2, 4, 6 and 7, however, reveals that each of these cutters on a secondary blade shares a common radial position with a cutter located on one of the primary blades 1, 3 or 5. More specifically, the common radial position is shared with a cutter on the immediately preceding primary blade. For example, the seventh cutter on secondary blade 2 has a same radial position (45.800) as the eighth cutter on immediately preceding primary blade 1. One of the arcuate dotted lines 24 on FIG. 1 shows this common radial position. Alternatively, the tenth and eleventh cutters on secondary blades 6 and 7 share a common radial position (53.700) with the ninth cutter on immediately preceding primary blade 5. One of the arcuate dotted lines 28 on FIG. 1 shows this common radial position.

Cutter Layout Table

| PDC cutter number | Radial Position | Blade position |
|---|---|---|
| 1 | 6.4 | 1 |
| 2 | 13.1 | 5 |
| 3 | 19.8 | 3 |
| 4 | 26.2 | 1 |
| 5 | 32.6 | 5 |
| 6 | 39.0 | 3 |
| 7 | 45.8 | 2 |
| 8 | 45.8 | 1 |
| 9 | 53.7 | 5 |
| 10 | 53.7 | 6 |
| 11 | 53.7 | 7 |
| 12 | 61.6 | 3 |
| 13 | 61.6 | 4 |
| 14 | 69.5 | 1 |
| 15 | 69.5 | 2 |
| 16 | 77.4 | 5 |
| 17 | 77.4 | 6 |
| 18 | 77.4 | 7 |
| 19 | 85.3 | 3 |
| 20 | 85.3 | 4 |
| 21 | 93.2 | 1 |
| 22 | 93.2 | 2 |
| 23 | 101.1 | 5 |
| 24 | 101.1 | 6 |
| 25 | 101.1 | 7 |
| 26 | 108.6 | 3 |
| 27 | 108.6 | 4 |
| 28 | 116.1 | 1 |
| 29 | 116.1 | 2 |
| 30 | 123.6 | 5 |
| 31 | 123.6 | 6 |
| 32 | 123.6 | 7 |
| 33 | 131.1 | 3 |
| 34 | 131.1 | 4 |

Figure 3:
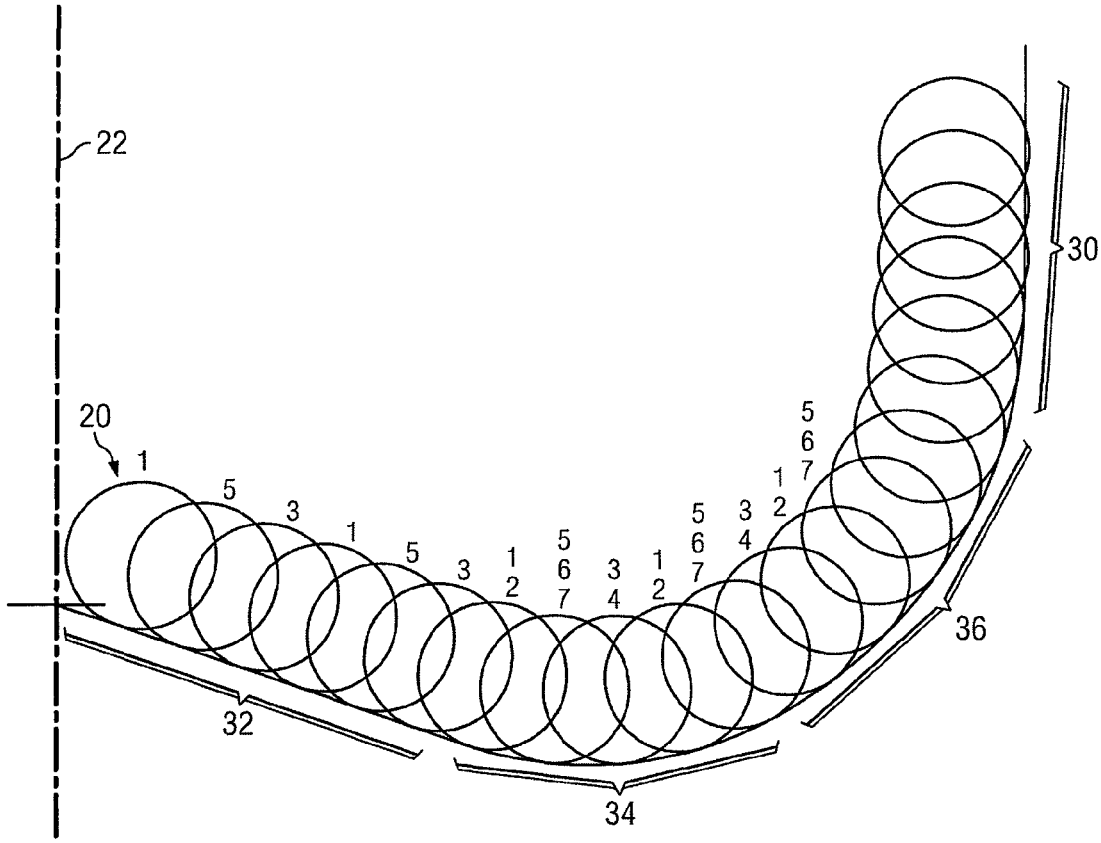
FIG. 3 shows a cutter profile for a bit having a multi-set PDC cutter layout as shown in FIG. 1.

Reference is now made to FIG. 3 which shows a cutter profile for a bit having a multi-set PDC cutter layout as shown in FIG. 1. As is known to those skilled in the art, the cutter profile illustrates the relative positions of all included cutters 20 (or 122) when rotated into a common plane. Each of the circles 20 represents at least one PDC cutter 22 on the bit. FIG. 3 has been partially annotated such that the number provided above certain ones of the circles 20 identifies the number of the blade (or blades) upon which a cutter 122, at the radial position from axis 22 shown by circle, has been provided by the multi-set layout as described. This matches with the information provided in the Cutter Layout Table above and the arcuate dotted lines 24, 26 and 28 on FIG. 1.

It will be noted that in the cone portion 32 of the bit, the PDC cutters are primarily, if not exclusively, provided in accordance with the traditional "single set" methodology. In the nose portion 34, shoulder portion 36 and gage portion 30, however, of the bit, the PDC cutters are exclusively provided in accordance with a redundant, plural set, technique as described herein so as to form a bit with a multi-set characteristic. Importantly, the provided redundancy is a redundancy wherein the PDC cutters on each secondary blade have common radial positions to some of the PDC cutters on the immediately preceding blade. More specifically, because of the "single set" methodology used to set cutter positions on the primary blades, the PDC cutters on each secondary blade have common radial positions to some of the PDC cutters exclusively on the immediately preceding blade (and no other included primary blade).

FIG. 3 still further shows that the PDC cutters in a given set all have a same location on the bit profile (exposure height). For example, the circles of FIG. 3 annotated with a label 5-6-7 indicates a set of three cutters on blades 5, 6 and 7 having a same radial position further having a same exposure height. Likewise, the circles in FIG. 3 annotated with a label 1-2 or 3-4 each indicate a set of two cutters on blades 1 and 2, or 3 and 4, respectively, having a same radial position further having a same exposure height. The provision of a same exposure height is preferred since it allows the cutters on the secondary blades to participate in rock trimming in a "free cut" mode, and ride in the groove cut by the primary blade, as described below.

The exemplary bit of FIGS. 1-3 is a seven bladed bit with three primary blades, four secondary blades, and a configuration where redundancy is provided between blades 1-2, blades 3-4 and blades 5-6-7. In this configuration, blade 1 is identified as the single set primary blade having a first PDC cutter whose radial position is closest to the axis 22. The remaining blades are numbered, starting with blade number two, in a clockwise manner when looking at the face of the bit for a bit which is designed to rotate in the direction of arrow 38 (see FIG. 1). The adjacent blades which share at least some PDC cutters at common radial positions may be referred to herein as a "family" of blades, and the common radial position cutters within that "family" of blades may be referred to herein as a "set" of cutters. FIG. 1 shows three families 40 of blades, and the arcuate dotted lines 24, 26 and 28 illustrate the sets of PDC cutters in each of those blade families. It will be noted that the secondary/tertiary blades 6 and 7 are selected such that the redundancy of their cutters is provided on the blades which immediately precede the first blade (i.e., that blade having the cutter most closely radially positioned to the axis 22). It is believed that this positioning is advantageous in terms of efficient operation of the bit and force balancing of the bit during design.

Those skilled in the art will recognize that the seven-bladed configuration of FIGS. 1-3 is just an example of the multi-set implementation and that the concepts described herein are equally applicable to bits with any selected odd or even number of blades. Consistent therewith, the following lists examples of different bit configurations for which the multi-set configuration can be implemented:

Four blades (type I): Blades 1 and 3 are primary blades set with PDC cutters in accordance with the traditional "single set" methodology, and blades 2 and 4 are secondary blades set with PDC cutters in accordance with a type of redundant, "plural set," methodology as described herein to form a multi-set bit. Redundancy is provided between blades 1-2 and between blades 3-4. Two families of blades are present.

Four blades (type II): Blades 1, 2 and 3 are the primary blades set with PDC cutters in accordance with the traditional "single set" methodology, and blade 4 is the sole secondary blade set with PDC cutters in accordance with a type of redundant, "plural set," methodology as described herein to form a multi-set bit. Redundancy is provided between blades 3-4. Three families of blades are present.

Five blades (type I): Blades 1 and 3 are primary blades set with PDC cutters in accordance with the traditional "single set" methodology, and blades 2, 4 and 5 are secondary blades set with PDC cutters in accordance with a type of redundant, "plural set," methodology as described herein to form a multi-set bit. Redundancy is provided between blades 1-2 and between blades 3-4-5. Two families of blades are present.

Five blades (type II): Blades 1, 3 and 5 are primary blades set with PDC cutters in accordance with the traditional "single set" methodology, and blades 2 and 4 are secondary blades set with PDC cutters in accordance with a type of redundant, "plural set," methodology as described herein to form a multi-set bit. Redundancy is provided between blades 1-2 and between blades 4-5. Three families of blades are present.

Six blades (type I): Blades 1, 3 and 5 are primary blades set with PDC cutters in accordance with the traditional "single set" methodology, and blades 2, 4 and 6 are secondary blades set with PDC cutters in accordance with a type of redundant, "plural set," methodology as described herein to form a multi-set bit. Redundancy is provided between blades 1-2, between blades 3-4 and between blades 5-6. Three families of blades are present.

Six blades (type II): Blades 1, 3 and 4 are primary blades set with PDC cutters in accordance with the traditional "single set" methodology, and blades 2, 5 and 6 are secondary blades set with PDC cutters in accordance with a type of redundant, "plural set," methodology as described herein to form a multi-set bit. Redundancy is provided between blades 1-2 and between blades 4-5-6. Three families of blades are present.

Seven blades (type I): Blades 1, 3 and 5 are primary blades set with PDC cutters in accordance with the traditional "single set" methodology, and blades 2, 4, 6 and 7 are secondary blades set with PDC cutters in accordance with a type of redundant, "plural set," methodology as described herein to form a multi-set bit. Redundancy is provided between blades 1-2, between blades 3-4 and between blades 5-6-7. Three families of blades are present.

Seven blades (type II): Blades 1, 4 and 5 are primary blades set with PDC cutters in accordance with the traditional "single set" methodology, and blades 2, 3, 6 and 7 are secondary blades set with PDC cutters in accordance with a type of redundant, "plural set," methodology as described herein to form a multi-set bit. Redundancy is provided between blades 1-2-3, and between blades 5-6-7. Three families of blades are present.

Eight blades (type I): Blades 1, 3, 5 and 7 are primary blades set with PDC cutters in accordance with the traditional "single set" methodology, and blades 2, 4, 6 and 8 are secondary blades set with PDC cutters in accordance with a type of redundant, "plural set," methodology as described herein to form a multi-set bit. Redundancy is provided between blades 1-2, between blades 3-4, between blades 5-6 and between blades 7-8. Four families of blades are present.

Eight blades (type II): Blades 1, 3 and 6 are primary blades set with PDC cutters in accordance with the traditional "single set" methodology, and blades 2, 4, 5, 7 and 8 are secondary blades set with PDC cutters in accordance with a type of redundant, "plural set," methodology as described herein to form a multi-set bit. Redundancy is provided between blades 1-2, between blades 3-4-5, and between blades 6-7-8. Three families of blades are present.

Nine blades (type I): Blades 1, 4 and 7 are primary blades set with PDC cutters in accordance with the traditional "single set" methodology, and blades 2, 3, 5, 6, 8 and 9 are secondary blades set with PDC cutters in accordance with a type of redundant, "plural set," methodology as described herein to form a multi-set bit. Redundancy is provided between blades 1-2-3, between blades 4-5-6, and between blades 7-8-9. Three families of blades are present.

Nine blades (type II): Blades 1, 3, 5 and 7 are primary blades set with PDC cutters in accordance with the traditional "single set" methodology, and blades 2, 4, 6, 8 and 9 are secondary blades set with PDC cutters in accordance with a type of redundant, "plural set," methodology as described herein to form a multi-set bit. Redundancy is provided between blades 1-2, between blades 3-4, between blades 5-6 and between blades 7-8-9. Four families of blades are present.

Ten blades (type I): Blades 1, 4, 6 and 9 are primary blades set with PDC cutters in accordance with the traditional "single set" methodology, and blades 2, 3, 5, 7, 8 and 10 are secondary blades set with PDC cutters in accordance with a type of redundant, "plural set," methodology as described herein to form a multi-set bit. Redundancy is provided between blades 1-2-3, between blades 4-5, between blades 6-7-8 and between blades 9-10. Four families of blades are present.

Ten blades (type II): Blades 1, 4 and 7 are primary blades set with PDC cutters in accordance with the traditional "single set" methodology, and blades 2, 3, 5, 6, 8, 9 and 10 are secondary blades set with PDC cutters in accordance with a type of redundant, "plural set," methodology as described herein to form a multi-set bit. Redundancy is provided between blades 1-2-3, between blades 4-5-6, and between blades 7-8-9-10. Three families of blades are present.

Eleven blades (type I): Blades 1, 4, 7 and 9 are primary blades set with PDC cutters in accordance with the traditional "single set" methodology, and blades 2, 3, 5, 6, 8, 10 and 11 are secondary blades set with PDC cutters in accordance with a type of redundant, "plural set," methodology as described herein to form a multi-set bit. Redundancy is provided between blades 1-2-3, between blades 4-5-6, between blades 7-8 and between blades 9-10-11. Four families of blades are present.

Eleven blades (type II): Blades 1, 5 and 8 are primary blades set with PDC cutters in accordance with the traditional "single set" methodology, and blades 2, 3, 4, 6, 7, 9, 10 and 11 are secondary blades set with PDC cutters in accordance with a type of redundant, "plural set," methodology as described herein to form a multi-set bit. Redundancy is provided between blades 1-2-3-4, between blades 5-6-7, and between blades 8-9-10-11. Three families of blades are present.

Twelve blades (type I): Blades 1, 4, 7 and 10 are primary blades set with PDC cutters in accordance with the traditional "single set" methodology, and blades 2, 3, 5, 6, 8, 9, 11 and 12 are secondary blades set with PDC cutters in accordance with a type of redundant, "plural set," methodology as described herein to form a multi-set bit. Redundancy is provided between blades 1-2-3, between blades 4-5-6, between blades 7-8-9 and between blades 10-11-12. Four families of blades are present.

Twelve blades (type II): Blades 1, 5 and 9 are primary blades set with PDC cutters in accordance with the traditional "single set" methodology, and blades 2, 3, 4, 6, 7, 8, 10, 11 and 12 are secondary blades set with PDC cutters in accordance with a type of redundant, "plural set," methodology as described herein to form a multi-set bit. Redundancy is provided between blades 1-2-3-4, between blades 5-6-7-8, and between blades 9-10-11-12. Three families of blades are present.

While two examples (types I and II) have been provided for each blade count, it will be recognized that other configurations sharing the same multi-set methodology may be possible for any given number of included blades. Such configurations will be readily apparent to one skilled in the art following the foregoing examples and teachings provided herein.

It will further be understood that each included cutter may be defined to have a certain back rake and side rake configuration. In other words, there need not be a common back rake and side rake configuration for each PDC on a given blade, or each PDC cutter included in a given set. This selection is left to the bit designer who may tweak the rake configurations as needed to achieve desired goals of the bit design.

FIGS. 1-3 illustrate only one row of cutters per blade. It will be understood, however, that a row of backup cutters may be provided on any one or more of the included blades (primary or secondary). If such backup cutters are provided, so that two (or more) rows of cutters exist on a single blade, the radial positions of the backup cutters would preferably match the radial positions of the corresponding primary cutters on that blade. The exposure height of the included backup cutters may be either: the same exposure height of the corresponding primary cutter, or a slightly lower exposure height than the corresponding primary cutter.

In field trials, a multi-set bit in accordance with the setting pattern described herein, has been shown to drill approximately 20% faster than an equally densely set traditional plural set bit while exhibiting equal or improved longevity. The bit has further proven to be very stable in operation and very good at maintaining verticality in vertical drilling implementations. It is believed that the presence of the cutters on the secondary blades, which are at the same radial position as corresponding cutters on the immediately preceding primary blade, serve as a stabilizer in the cutting groove being made by the cutters of the primary blade. It is additionally believed that the cutters on the secondary blades in effect get a chance to make a "free" second cut which serves to improve ROP. Some of the blade positions and cutter placements in accordance with the multi-set technique produce a non-symmetrical blade configuration, wherein the asymmetry is believed to contribute to suppressing bit whirl.

In connection with the foregoing, it is surmised that the cutters on the primary blade do not achieve full depth of cut due to some rebound of the formation. However, because the secondary blade with cutters at the same radial position immediately follows the primary blade, the amount of formation rebound is limited, and the cutters on the trailing secondary blade trim in "free cut" mode so that very little incremental torque is generated. When another secondary blade immediately follows, i.e., a tertiary blade with cutters at the same radial positions, this blade in essence rides in the grooves cut by the immediately preceding primary and secondary blades in an outrigger mode which advantageously limits lateral movement and vibration. It is believed that little additional cutting is done by the cutters on this tertiary blade, but nonetheless the cutters thereon are available for further clean up of the rebounded formation. With respect to the implementations with various blade counts, it is accordingly believed that there is an advantage to having the number of secondary blades exceed the number of primary blades so that at least one blade family on the bit would include plural secondary blades (i.e., at least one secondary blade immediately followed by a tertiary blade, each having radial cutter positions matching the primary blade) providing a redundancy between blades of the type x-y-z. Such can alternatively be achieved where the number of secondary blades is less than the number of primary blades by selectively placing the secondary blades so that at least one blade family includes plural secondary blades.

Embodiments of the invention have been described and illustrated above. The invention is not limited to the disclosed embodiments. Although preferred embodiments of the method and apparatus have been illustrated and described, it will be understood that the invention is not limited to the embodiments disclosed, but is capable of numerous rearrangements, modifications and substitutions within the scope of the disclosure and as understood by those skilled in the art.

What is claimed is:

1. A PDC bit, comprising:

a plurality of blades including primary blades and at least one secondary blade, wherein all primary blades include only single set PDC cutters, and wherein the at least one secondary blade includes only plural set PDC cutters such that each cutter on a secondary blade has a radial position that is identical to one single set cutter on the primary blade which is immediately preceding that secondary blade; and wherein the plurality of blades and PDC cutters are arranged to provide a force balanced PDC bit.

2. The bit of claim 1 wherein the plural set cutters on the secondary blade is set with an equal or nearly equal location on the bit profile as the single set cutters on the immediately preceding primary blade.

3. The bit of claim 1 wherein one of the primary blades is followed by two consecutive secondary blades, each of the consecutive secondary blades being set with PDC cutters such that each cutter on the consecutive secondary blades is placed at a radial position that is identical to one single set cutter placed on the immediately preceding one of the primary blades.

4. The bit of claim 3 wherein a first primary blade contains a PDC cutter having a closest radial position to an axis of the bit, and wherein the consecutive secondary blades immediately precede that first primary blade.

5. The bit of claim 1 wherein the plurality of blades have an even number of blades.

6. The bit of claim 1 wherein the plurality of blades have an odd number of blades.

7. A method for setting PDC cutters on blades of a bit, comprising:

defining a plurality of blades including primary blades and at least one secondary blade;

setting PDC cutters on all primary blades only in accordance with a single set methodology; and setting PDC cutters of the at least one secondary blade only using a plural set methodology such that each cutter on a secondary blade is placed at a radial position that is identical to one single set cutter placed on the primary blade which is immediately preceding that secondary blade; and arranging the plurality of blades and PDC cutters to provide a force balanced PDC bit.

8. The method of claim 7 further comprising setting the plural set cutters on the secondary blade with an equal or nearly equal location on the bit profile as the single set cutters on the immediately preceding primary blade.

9. The method of claim 7 wherein defining the plurality of blades comprises defining two consecutive secondary blades to immediately follow one of the primary blades, and wherein setting PDC cutters of the secondary blades comprises placing each cutter on the consecutive secondary blades at a radial position that is identical to one single set cutter placed on the immediately preceding one of the primary blades.

10. The method of claim 9 wherein defining the plurality of blades further comprises positioning the two consecutive secondary blades to immediately precede a first primary blade which contains a PDC cutter having a closest radial position to an axis of the bit.

11. A PDC bit, comprising:

a plurality of families of blades, each family of blades including a primary blade and at least one family of blades further including a secondary blade, wherein the primary blades across all families of blades include only single set PDC cutters, and wherein the secondary blade within a given one of the families of blades include only redundantly set PDC cutters at radial positions which equal the radial position of corresponding ones of the PDC cutters set on the primary blade of that given one of the families of blades to which the secondary blade belongs; and wherein the families of blades are arranged to provide a force balanced PDC bit.

12. The bit of claim 11 wherein the plural set cutters on the secondary blade is set with an equal or nearly equal location on the bit profile as the single set cutters on the immediately preceding primary blade.

13. A method for setting PDC cutters on blades of a bit, comprising:

defining a plurality of families of blades, each family of blades including a primary blade and at least one family of blades further including a secondary blade;

only single setting PDC cutters on the primary blades of all families of blades;

only redundantly setting the secondary blade within a given one of the families of blades with PDC cutters at radial positions which equal the radial position of corresponding ones of the PDC cutters set on the primary blade for that given one of the families of blades to which the secondary blade belongs; and arranging the families of blades to provide a force balance.

14. The method of claim 13 further comprising setting the plural set cutters on the secondary blade with an equal or nearly equal location on the bit profile as the single set cutters on the immediately preceding primary blade.

15. The method of claim 13 wherein certain families of blades include only primary blade and no immediately following secondary blade.

* * * * *